US006554406B1

(12) United States Patent
Ohno et al.

(10) Patent No.: US 6,554,406 B1
(45) Date of Patent: Apr. 29, 2003

(54) INKJET RECORDING HEAD AND METHOD OF PRODUCING THE SAME

(75) Inventors: Kenichi Ohno, Tokyo (JP); Torahiko Kanda, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/806,661

(22) PCT Filed: Nov. 30, 1999

(86) PCT No.: PCT/JP99/06697

§ 371 (c)(1),
(2), (4) Date: Mar. 30, 2001

(87) PCT Pub. No.: WO00/34047

PCT Pub. Date: Jun. 15, 2000

(30) Foreign Application Priority Data

Dec. 7, 1998 (JP) ..... 10-346970

(51) Int. Cl.[7] ..... B41J 2/16
(52) U.S. Cl. ..... 347/68; 347/71
(58) Field of Search ..... 347/54, 68, 69, 347/70, 71, 72

(56) References Cited

U.S. PATENT DOCUMENTS 5,368,683 A 11/1994 Altavela et al. ..... 156/633
5,659,346 A 8/1997 Moynihan et al. ..... 347/68
5,748,214 A 5/1998 Usui et al. ..... 347/70

FOREIGN PATENT DOCUMENTS

| | | |
|---|---|---|
| EP | 0695638 | 2/1996 |
| EP | 0 7196422 | 7/1996 |
| JP | 5-330067 | 12/1993 |
| JP | 7-125200 | 5/1995 |
| JP | 8-58089 | 3/1996 |
| JP | 10-58681 | 3/1998 |
| JP | 10-114076 | 5/1998 |

OTHER PUBLICATIONS

EP Search Report dated Aug. 30, 2002.

*Primary Examiner*—Anh T. N. Vo
(74) *Attorney, Agent, or Firm*—Dickstein, Shapiro, Morin & Oshinsky, LLP.

(57) ABSTRACT

To suppress adhesive extrusion in an ink flow path and irregularities or air bubbles (void) in the adhesive layer, thus enabling to improve reliability and yield as well as reduce the production cost. An ink jet printing head comprising a plurality of substrates having a hole or groove which are attached to one another via an adhesive layer, wherein thickness of adhesive is adjusted according to a thinner substrate as a reference of two substrates to be attached to each other in such a way that the thickness of the adhesive becomes thinner as the reference substrate becomes thinner and thicker as the reference substrate becomes thicker.

15 Claims, 8 Drawing Sheets

INKJET RECORDING HEAD AND METHOD OF PRODUCING THE SAME

BACKGROUND OF THE INVENTION

1. Field of the Invention

The present invention relates to an ink jet printing head and a production thereof and in particular, to an ink jet printing head for discharging an ink droplet to a recording medium for image printing and a production method of the ink jet printing head.

2. Description of the Related Art

Conventionally, for example, this type of ink jet printing head is disclosed in Japanese Patent Publication No. A8-58089 [1].

FIG. 8 is a cross sectional view schematically showing a printing head identical to the one disclosed in Citation [1]. As shown here, the printing head, the conventional printing head includes: a nozzle plate 21, a pool plate 22, a supply perforation plate 23, a sealing plate 24, a pressure generating chamber 25, and a vibration plate 26 which are layered and to which an actuator 27 is mounted.

Moreover, in the nozzle plate 21, a nozzle 28 is formed for discharging ink. This nozzle 28 is connected to the pressure generating chamber 30 via a ink through hole 29 formed in the pool plate 22, the ink supply hole plate 23, and the sealing plate 24. Moreover, this pressure generating chamber 28 is connected to the ink pool 33 formed in the pool plate 22, via a supply communication path 31 formed in the sealing plate 24 and a ink supply hole 32 formed in the ink supply hole plate 23.

Thus, in the conventional method, a plurality of substrates having a nozzle 28 and the ink pool 33 are layered and an actuator 30 is attached to prepare an ink jet printing head. For attachment of the plurality of plates, adhesive is used.

When using adhesive for attachment between plates, there is a danger of adhesive clogging in the hole or groove such as a nozzle and nozzle communication hole.

In order to solve this problem, Japanese Patent Publication No. A5-330067 [2] discloses a technique to provide an escape groove in the vicinity of the nozzle so as to clear an unnecessary portion of the adhesive.

FIG. 9 is a perspective view of an ink jet printing head disclosed in Citation [2]. As shown here, a liquid adhesive 37 is applied as a thin film onto the surface of a plate 34 by way of 'transfer' or 'printing', and a plate 38 is mounted thereon.

The plate 34 has on its surface an escape groove 36 for cleaning an unnecessary portion of the adhesive to suppress intrusion of the adhesive into the nozzle groove 35. Moreover, when such plates are multi-layered, the adhesive thickness values are identical.

However, it can not be said sufficient to provide an escape groove of the adhesive.

In general, in an ink jet printing head as shown in FIG. 8, the plate thickness differs depending on its purpose. For example, the vibration plate 26 should be thin enough to effectively transfer the vibration of the actuator 27 to the pressure generating chamber 30. Moreover, the ink plate 22 should be thick enough to assure a sufficient volume of the ink pool.

However, when an escape groove is to be provided as disclosed in Citation 2, in multi-layered plates having different thickness values, it is difficult to provide an escape groove in a thin plate. That is, it is impossible to form a groove having a depth greater than the thin plate thickness. It is also considered to increase width of the groove in the horizontal direction. However, if a groove has a wide width, there arise problems of plate strength and warp. Moreover, if a large groove is formed, the adhesion application area is decreased and the adhesive layer may not be uniform and have air bubbles (void).

SUMMARY OF THE INVENTION

The present invention intends to solve these problems. The object of the present invention is to provide an ink jet printing head and its production method capable of suppressing extrusion of adhesive into an ink flow path and increasing reliability and yield without causing irregularities or air bubbles (void) as well as reducing the production cost.

In order to achieve the object, claim 1 discloses an ink jet printing head comprising a plurality of substrates having a hole or groove which are attached to one another via an adhesive layer, wherein thickness of adhesive is adjusted according to a thinner substrate as a reference of two substrates to be attached to each other in such a way that the thickness of the adhesive becomes thinner as the reference substrate becomes thinner and thicker as the reference substrate becomes thicker.

Thus, according to the present invention, adhesive layer thickness is determined according to a thinner one of two adjacent substrates. Accordingly, it is possible to prevent extrusion of adhesive and clogging of a hole and groove provided on the respective substrates.

Claim 2 discloses an ink jet printing head as claimed in claim 1, wherein the plurality of substrates are constituted by: a nozzle plate having a nozzle for discharging ink; a pool plate having an ink pool and a first nozzle communication hole; a ink supply hole plate having a ink supply hole and a second nozzle communication hole; a chamber plate having a pressure generating chamber; and a vibration plate having an actuator for generating displacement, wherein the nozzle is connected to the pressure generating chamber via the first and the second ink through holes, and the pressure generating chamber is connected to the ink pool via the ink supply hole.

Moreover, claims 3 and 4 discloses an ink jet printing head as claimed in one of claim 1 and claim 2, wherein each of the adhesive layers is formed by an epoxy adhesive with a thickness 1 to 4 micrometers.

Thus, the present invention can further suppress extrusion of the adhesive. No air bubble (void) remains if the thickness is equal to or above 1 micrometer.

Moreover, claim 5 discloses a production method of an ink jet printing head comprising a plurality of substrates having a hole or groove which are attached to one another via an adhesive layer, wherein thickness of adhesive is adjusted according to a thinner substrate as a reference of two substrates to be attached to each other in such a way that the thickness of the adhesive becomes thinner as the reference substrate becomes thinner and thicker as the reference substrate becomes thicker.

Thus, according to the present invention, adhesive layer thickness is determined according to a thinner one of two adjacent substrates. Accordingly, it is possible to prevent extrusion of adhesive and clogging of a hole and groove provided on the respective substrates.

Moreover, claim 6 discloses an ink jet printing head production method as claimed in claim 5, wherein the plurality of substrates are constituted by: a nozzle plate having a nozzle for discharging ink; a pool plate having an ink pool and a first nozzle communication hole; a ink supply hole plate having a ink supply hole and a second nozzle communication hole; a chamber plate having a pressure generating chamber; and a vibration plate having an actuator for generating displacement; wherein the nozzle is connected to the pressure generating chamber via the first and the second ink through holes, and the pressure generating chamber is connected to the ink pool via the ink supply hole.

Moreover, Claim claims 7 and 8 discloses an ink jet printing head production method as claimed in one of claim 5 and 6, wherein each of the adhesive layers is formed by an epoxy adhesive with a thickness 1 to 4 micrometers.

Thus, the present invention can further suppress extrusion of adhesive and no irregularities or air bubbles (void) remain if the thickness is equal to or more than 1 micrometer.

Moreover, claim 9 discloses an ink jet printing head production method as claimed in claim 6, comprising steps of: applying adhesive onto the nozzle plate so as to form an adhesive layer and mounting the pool plate thereon; applying adhesive onto the pool plate so as to form an adhesive layer and mounting the ink supply hole plate thereon; applying adhesive onto the ink supply hole plate so as to form an adhesive layer and mounting the chamber plate thereon; and applying adhesive onto the pressure generating chamber plate so as to form an adhesive layer and mounting the vibration plate thereon; wherein the thickness values of the respective adhesive layers are adjusted in proportion to the respective thickness values of the substrates to be attached to the nozzle plate.

Thus, according to the present invention, when successively mounting plates onto the nozzle plate, the adhesive extrusion is caused mainly at the nozzle plate side. By defining the adhesive layer thickness according to the respective plate thickness values, it is possible to reduce the extrusion and increase the air tightness between the plates. When the plate thickness is small, the hole and groove formed in the plate have an inner wall of small area, and the adhesive layer thickness is also made small. Accordingly, it is possible to prevent extrusion of the adhesive into the hole and groove which may cause clogging.

Moreover, claim 10 discloses an ink jet printing head production method as claimed in claim 9, wherein each time a substrate is attached to the nozzle plate side, the substrate is pressed with a pressure proportional to thickness of the substrate.

When successively mounting plates on the nozzle plate, the adhesive extrusion is caused mainly at the nozzle plate side. Each of the plates is pressed with a force proportional to the plate thickness. This reduces extrusion and increases the air tightness between the plates. When the plate thickness is small, the hole and groove formed in the plate has a small area of inner wall. However, the pressure applied to the plate is proportional to the thickness. Thus, it is possible to prevent adhesive extrusion and accompanying clogging of the hole and groove formed in each plate.

Moreover, claim 11 discloses an ink jet printing head production method as claimed in 6, comprising steps of: applying adhesive onto the vibration plate to form an adhesive layer, and attaching the chamber plate onto the vibration plate; applying adhesive onto the chamber plate to form an adhesive layer, and attaching the ink supply hole plate onto the chamber plate; applying adhesive onto the ink supply hole plate to form an adhesive layer, and attaching the pool plate onto the ink supply hole plate; and applying adhesive onto the pool plate to form an adhesive layer, and attaching the nozzle plate onto the pool plate; wherein the respective adhesive layers have thickness values proportional to the thickness of the substrates attached to the vibration plate side.

When successively mounting plates on the vibration plate, the adhesive extrusion occurs mainly at the vibration plate side. Accordingly, by adjusting the adhesive layer thickness according to the plate thickness, it is possible to reduce the extrusion and increase the air tightness between the plates. When the plate thickness is small, the hole and groove formed in the plates also have a small area of inner wall. However, the adhesive layer thickness is also reduced. Accordingly, it is possible to prevent adhesive extrusion into the hole and groove, causing clogging.

Moreover, claim 12 discloses an ink jet printing head production method as claimed in claim 11, wherein each time a substrates is attached, the substrate is pressed with a pressure proportional to the thickness of the substrate.

When successively mounting plates on the vibration plate, the adhesive extrusion occurs mainly at the vibration plate side of the adhesive layer. By pressing a plate to be attached with a force roughly proportional to the plate thickness, it is possible to reduce the extrusion and increase the air tightness between the plates. When a plate thickness is small, the pressure applied to the plate is also made small. Accordingly, it is possible to prevent adhesive extrusion into the hole and groove, causing a clogging.

Moreover, claims 13–15 discloses an ink jet printing head production method as claimed in one of claims 5 to 12, wherein the adhesive layers in the vicinity of a hole or indentation are hardened in a time shorter than the other region of the adhesive layers.

Thus, according to the present invention, in the vicinity of a small hole, the adhesive is hardened before extrusion. Thus, adhesive extrusion can be prevented.

Thus, the present invention suppresses adhesive extrusion into the ink flow path and causes no irregularities or air bubble (void) in the adhesive layer. Consequently, the present invention increases reliability and yield as well as reduces the production cost.

DESCRIPTION OF THE PREFERRED EMBODIMENTS

Next, explanation will be given on embodiments of the present invention.

[Embodiment 1]

Figure 1:
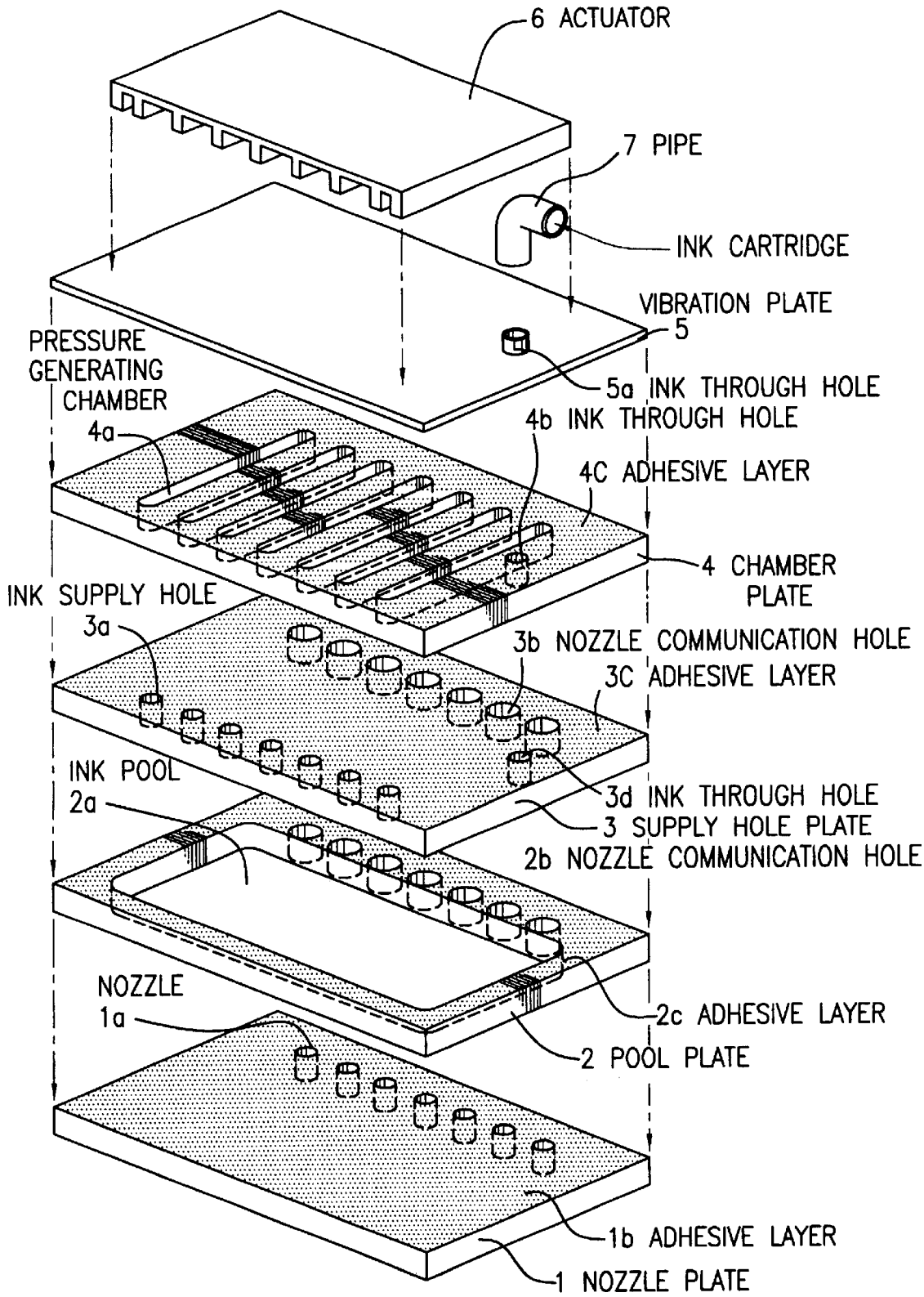
FIG. 1 is an exploded perspective view of the first embodiment of the present invention.

FIG. 1 is an exploded perspective view of a first embodiment of the present invention. As shown here, the present embodiment is constituted by a nozzle plate 1, a pool plate 2, a ink supply hole plate 3, a chamber plate 4, and a vibration plate which are successively mounted and layered, and an actuator 6 mounted to the layered plates. The plates are attached to one another via adhesive layers 1*b,* 2*c,* 3*c,* and 4*c*.

In order to attach a plurality of substrates, a plurality of adhesive layers are used. The adhesive thickness is adjusted according to one of the plates attached each other (which is thinner). Thus, an adhesive layer used for attaching a thin substrate is thinner than an adhesive layer used for attaching a thick layer. In other words, the adhesive layer thickness used for attaching a thick substrate is thicker than the adhesive layer thickness used for attaching a thin substrate.

Moreover, the nozzle plate 1 has a nozzle 1*a* for discharging ink. This nozzle plate 1*a* communicate with the pressure generating chamber 4*a* via nozzle communication holes 2*b* and 3*b* formed on the pool plate 2 and the ink supply hole plate 3, respectively.

The pressure generating chamber 4*a* is connected to the ink pool 2*a* formed in the pool plate 2, via the ink supply hole 3*a* formed in the ink supply hole plate 3.

The ink pool 2*a* is connected to an ink cartridge (not depicted) via ink through holes 3*d,* 4*b,* and 5*a* respectively formed on the ink supply hole plate 3, pressure generating chamber plate 4, and a vibration plate 5, and a pipe 7.

Here, explanation will be given on a production procedure of the present embodiment.

Firstly, adhesive is applied to a surface of the nozzle plate 1 not performing ink discharge, so as to form an adhesive layer 1*b,* onto which the pool plate 2 is mounted. Here, the thickness of the adhesive layer 1*b* is adjusted according to the thickness of the pool plate 2 layered on the nozzle plate 1.

Next, in the same way as mentioned above, adhesive is applied onto the free surface of the pool plate 2 attached to the nozzle plate 1, so as to form an adhesive layer 2*c,* and then the ink supply hole plate 3 is attached thereon. Here, the thickness of the adhesive layer 2*c* is adjusted according to the thickness of the pool plate 2 and the thickness of the ink supply hole plate 3.

Next, in the same way as mentioned above, adhesive is applied to a free surface of the ink supply hole plate 3 attached to the pool plate 2, so as to form an adhesive layer 3*c,* onto which the chamber plate 4 is attached. Here, the thickness of the adhesive layer 3*c* is adjusted according to the thickness of the ink supply hole plate 3 and the thickness of the chamber plate 4.

Next, adhesive is applied onto a free surface of the chamber plate 4 attached to the ink supply hole plate 3, so as to form an adhesive layer 4*c,* onto which the vibration plate 5 is attached. Here, the thickness of the adhesive layer 4*c* is adjusted according to the thickness of the chamber plate 4 and the thickness of the vibration plate 5.

After this, the layered plates are subjected to a pressure and heat to harden the adhesive. Furthermore, the actuator 6 and the pipe 7 are mounted on the vibration plate 5, thus completing the ink jet printing head.

In the aforementioned procedure, the adhesive is applied to the lower substrate onto which an upper substrate is to be attached. However, it is also possible to apply the adhesive to a lower surface of the upper substrate.

That is, the adhesive is applied to the lower surface (the nozzle plate 1 side) of the pool plate 2 so as to form an adhesive layer and the pool plate 2 is attached to the nozzle plate 1. After this, an adhesive layer is formed on the lower surface (pool plate 2 side) of the ink supply hole plate 3, and the ink supply hole plate 3 is attached to the pool plate 2. Furthermore, the chamber plate 4 and the vibration plate 5 are attached in the same way. Lastly, the layered substrates are heated to harden the adhesive layers. It should be noted that this can also be applied to the embodiments which will be detailed later.

As has been described above, in this embodiment, thickness of adhesive is determined according to a thinner plate of two plates to be attached to each other. Accordingly, it is possible to prevent extrusion of the adhesive into holes and grooves provided in the plates which results in clogging.

It should be noted that if adhesive amount appropriate for the thickest plate is applied to the other plates, the extrusion of the adhesive at the thinnest plate becomes so great that the adhesive may clog the holes or the like. Moreover, if adhesive amount appropriate for the thinnest plate is applied to the other plates, it is impossible to obtain air tightness and an adhesive layer may peel off from the substrate.

Consequently, the present invention in which the adjustment of adhesive layer thickness according to the thickness of the plate is advantageous to solve the aforementioned problem. That is, when attaching a thin plate, hole clogging is suppressed as well as the peeling off of the adhesive layer can be suppressed to minimum. This improves yield of the ink jet head. It should be noted that experiment results will be detailed later in the paragraph of Experiments.

Here, explanation will be given on the extrusion of adhesive depending on the substrate thickness and the adhesive layer thickness.

Figure 2:
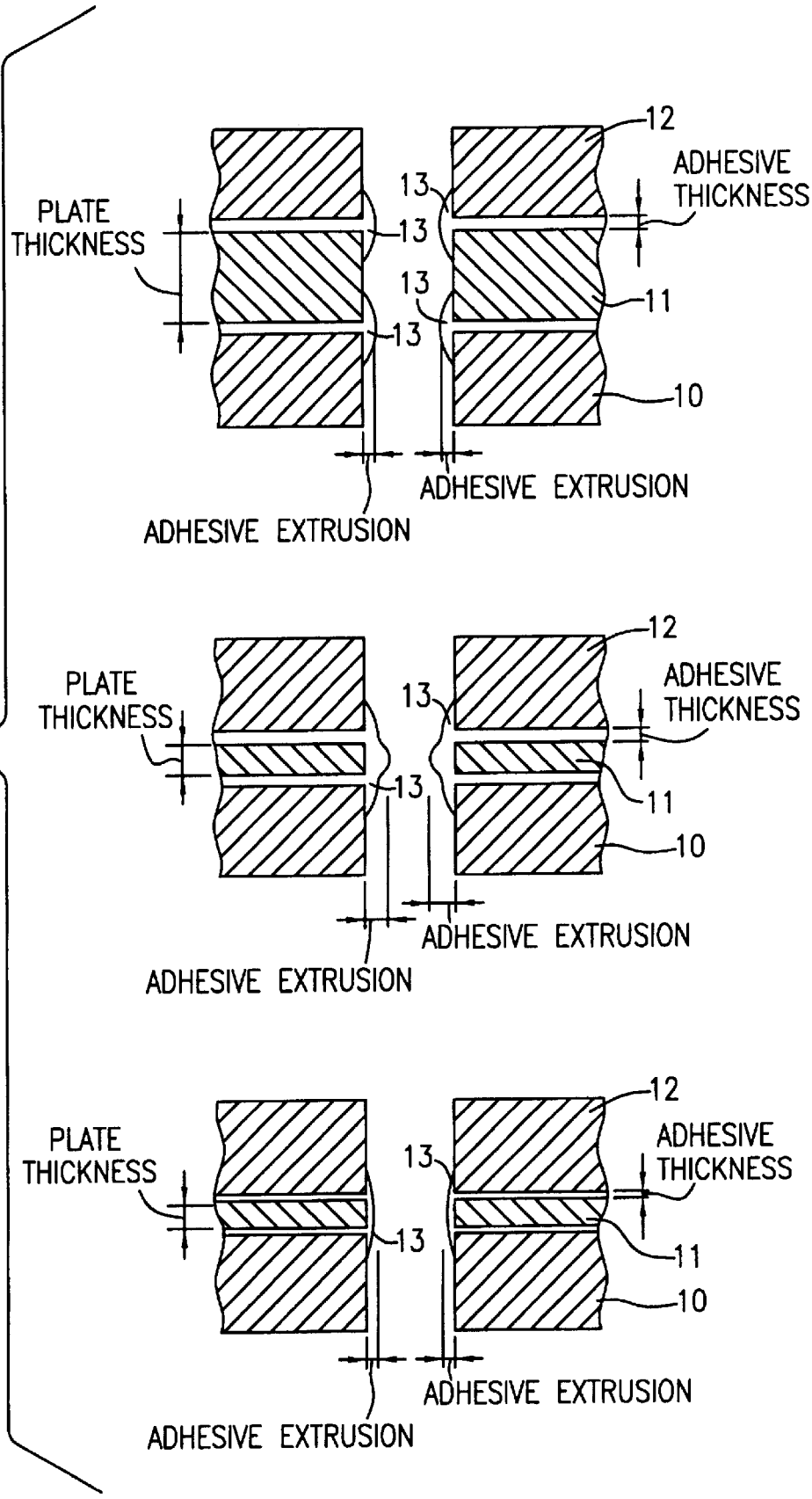
FIG. 2 is a cross sectional view showing adhesive extrusion into ink through holes of layered substrates.

FIG. 2 is a cross sectional view showing extrusion of the adhesive in the ink through hole of the layered substrates. As shown here, substrates 10, 11, and 12 are successively attached to constitute a layered structure having a ink through hole.

Firstly, as shown FIG. 2(*a*), if the substrate 11 has a sufficient thickness, the inner wall of the ink through hole also has a sufficiently large area. Accordingly, the extruded adhesive spreads along the inner wall of the ink through hole and with a small extrusion in the radial direction of the ink through hole.

However, as shown in FIG. 2(*b*), when the adhesive layer thickness is same as in FIG. 2(*a*) but the substrate 11 has a smaller thickness than that of FIG. 2(*a*), the adhesive extrusion amount is increased and the extrusion in the radial direction is increased.

Here, as shown in FIG. 2(*c*), when the substrate 11 has a small thickness, the adhesive layer thickness is also decreased. Then, the extrusion volume of the adhesive 12 becomes smaller with less extrusion in the radial direction.

Figure 3:
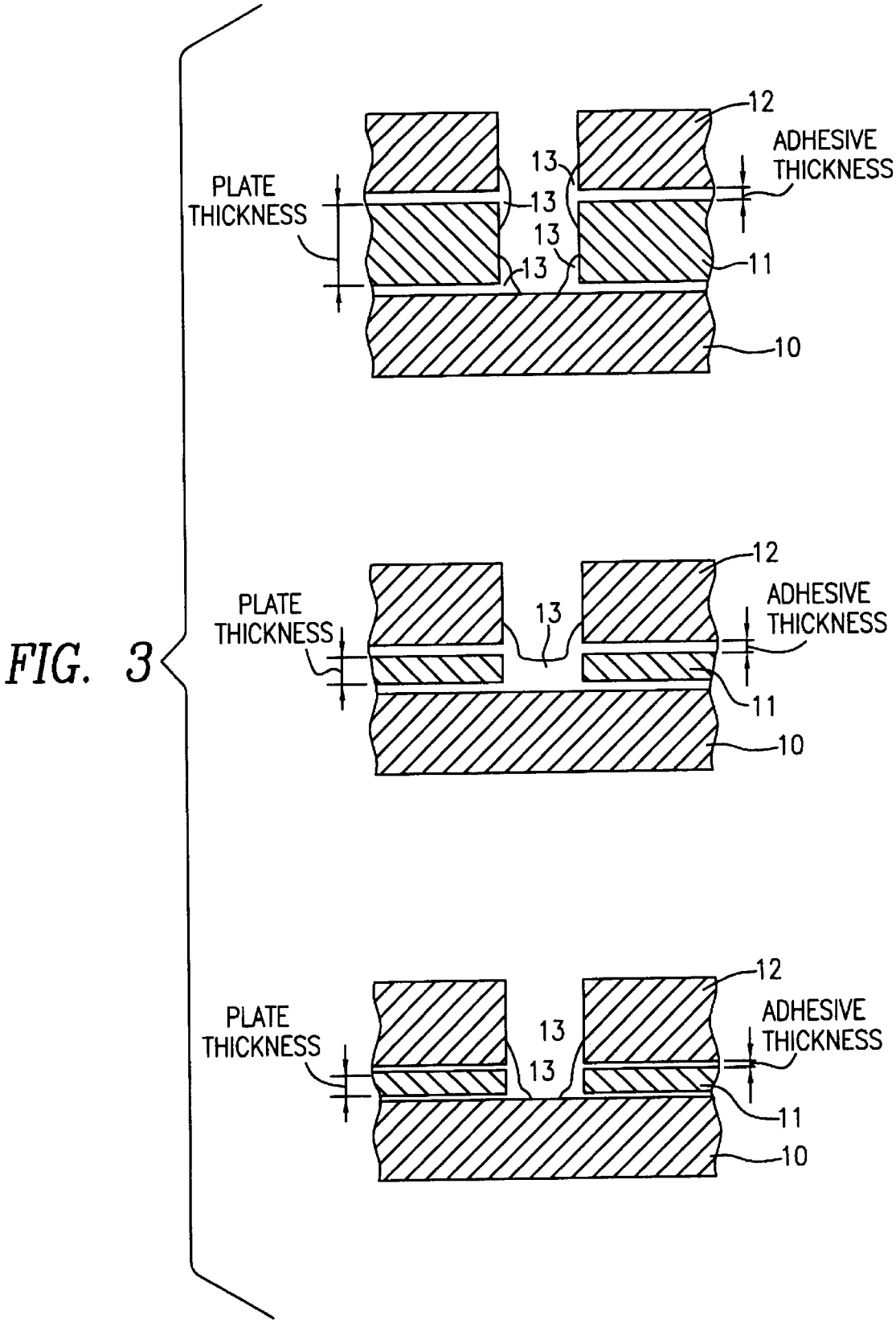
FIG. 3 is a cross sectional view showing adhesive extrusion into grooves of layered substrates.

FIG. 3 is a cross sectional view of layered substrates having a groove where the adhesive is extruded. As shown here, the substrates 10, 11, and 12 are successively attached to constitute a layered structure having a groove with a bottom defined by the substrate 10.

Firstly, as shown in FIG. 3(*a*), when the substrate 11 has a sufficiently thick, the extruded adhesive spreads along the inner wall of the ink through hole with a small extrusion in the radial direction of the ink through hole.

However, as shown in FIG. 3(*b*), when the substrate 11 has a thickness smaller than that of FIG. 2(*a*) while the adhesive layer thickness remains as it is, the amount of the extruded adhesive is increased and the extruded adhesive 13 fill a part of the groove.

To cope with this, as shown in FIG. 3(*c*), the adhesive layer thickness is made smaller when the substrate 11 has a smaller thickness. Thus, the amount of the extruded adhesive 13 is reduced and it is possible to prevent filling of the groove.

[Embodiment 2]

Description will now be directed to a second embodiment of the present invention.

In general, extruded portion of adhesive into a hole or groove tends to flow downward by the gravitation and then spread horizontally. For this, in the present embodiment, the thickness of the adhesive layer is adjusted according to thickness of a lower substrate viewed from the adhesive layer. That is, when the adhesive layer thickness values are compared, the adhesive layer used for attaching a thin substrate is thinner than the adhesive layer used for attaching a thick substrate. However, the thickness is determined by a lower substrate viewed from the adhesive layer.

Here, a specific procedure will be explained with reference to FIG. 1.

Firstly, adhesive is applied to an upper surface of the nozzle plate 1 not discharging ink, so as to form an adhesive layer 1*b,* onto which the pool plate 2 is mounted. Here, the adhesive extruded into a hole tends to flow downward. Accordingly, the thickness of the adhesive layer 1*b* is adjusted according to the thickness of the nozzle plate 1.

Next, in the same way as mentioned above, adhesive is applied onto the free surface (opposite to the nozzle plate 1) of the pool plate 2, so as to form an adhesive layer 2*c,* and then the ink supply hole plate 3 is attached thereon. Here, the thickness of the adhesive layer 2*c* is adjusted according to the thickness of the pool plate 2.

Next, in the same way as mentioned above, adhesive is applied to a free surface (opposite to the nozzle plate 1) of the ink supply hole plate 3, so as to form an adhesive layer 3*c,* onto which the chamber plate 4 is attached. Here, the thickness of the adhesive layer 3*c* is adjusted according to the thickness of the ink supply hole plate 3.

Next, adhesive is applied onto a free surface (opposite the nozzle plate 1) of the chamber plate 4, so as to form an adhesive layer 4*c,* onto which the vibration plate 5 is attached. Here, the thickness of the adhesive layer 4*c* is adjusted according to the thickness of the chamber plate 4.

After this, the layered plates are subjected to a pressure and heat to harden the adhesive. Furthermore, the actuator 6 and the pipe 7 are mounted on the vibration plate 5, thus completing the ink jet printing head.

[Embodiment 3]

Description will now be directed to a third embodiment of the present invention.

In the present embodiment, after each substrate is attached to another substrate, load is applied which is changed according to the thickness of the substrate to be attached. This is the difference between the present embodiment and the aforementioned first and second embodiments.

Figure 4:
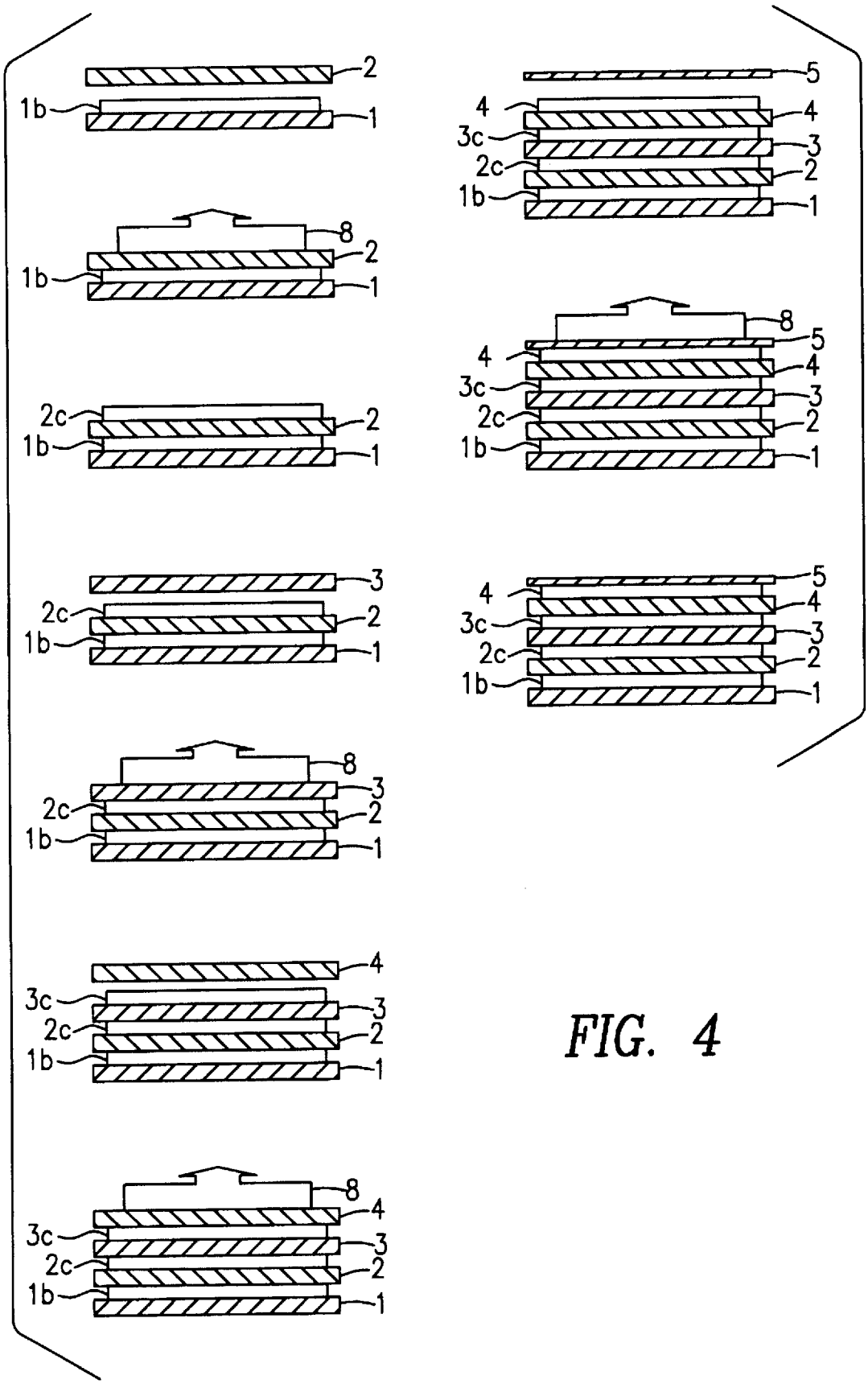
FIG. 4 is a cross sectional view of the third embodiment of the present invention.

FIG. 4 is a cross sectional view of the third embodiment of the present invention.

Firstly, as shown in FIG. 4(*a*), adhesive is applied to the free surface (not discharging ink) of the nozzle plate 1, so as to form an adhesive layer 1*b,* onto which the pool plate 2 is attached. Here, the thickness of the adhesive layer 1*b* is adjusted according to thickness values of the nozzle plate 1 and the pool plate 2. Of course, it is also possible to adjust the adhesive layer thickness according to the nozzle plate 1 like in the second embodiment.

Next, as shown in FIG. 4(*b*), a load (weight) 8 is applied to the layered substrates while subjected to heat, so as to harden the adhesive layer 1*b*. The load value is adjusted according to the thickness of the substrate having the adhesive layer (nozzle plate 1). As the thickness increases, the load is also increased, and as the thickness decreases, the load is decreased.

Next, as shown in FIG. 4(*c*), after the pool plate 2 is attached onto the nozzle plate 1, adhesive is applied to the free surface (opposite to the nozzle plate 1) of the pool plate 2, so as to form an adhesive layer 2*c,* onto which the ink supply hole plate 3 is attached. Here, thickness of the adhesive layer 2*c* is adjusted according to the thickness values of the pool plate 2 and the ink supply hole plate 3. Of course, it is also possible to make adjustment according to the thickness of the pool plate 2.

Next, as shown in FIG. 4(*d*), the ink supply hole plate 3 is attached to the pool plate 2.

Subsequently, as shown in FIG. 4(*e*), the layered substrates are subjected to load 8 and heat, so as to harden the adhesive layer 2*c*. The load is adjusted according to the substrate having the adhesive layer (pool plate 2). As the substrate becomes thicker, more load is applied, and as the substrate becomes thinner, less load is applied.

After this, the steps of FIG. 4(*f*) to FIG. 4(*j*) are performed in the same way as mentioned above.

After that, the actuator 6 and the pipe 7 are attached to the vibration plate 5, thus completing the ink jet printing head.

Thus, in the present embodiment, the pressure applied to the layered substrates is changed according to the substrate thickness. That is, if the substrate is thin, a small pressure is applied and accordingly, it is possible to prevent extrusion of the adhesive into the holes and grooves provided in the substrates. It should be noted that if the substrate thick, the load is increased, which leads to more extrusion of adhesive. However, when the thickness is great, a hole has a large inner wall area. Even if the adhesive is extruded, the extrusion will not reach the back of the substrate or clog the hole.

[Embodiment 4]

Description will now be directed to the fourth embodiment of the present invention.

Figure 5:
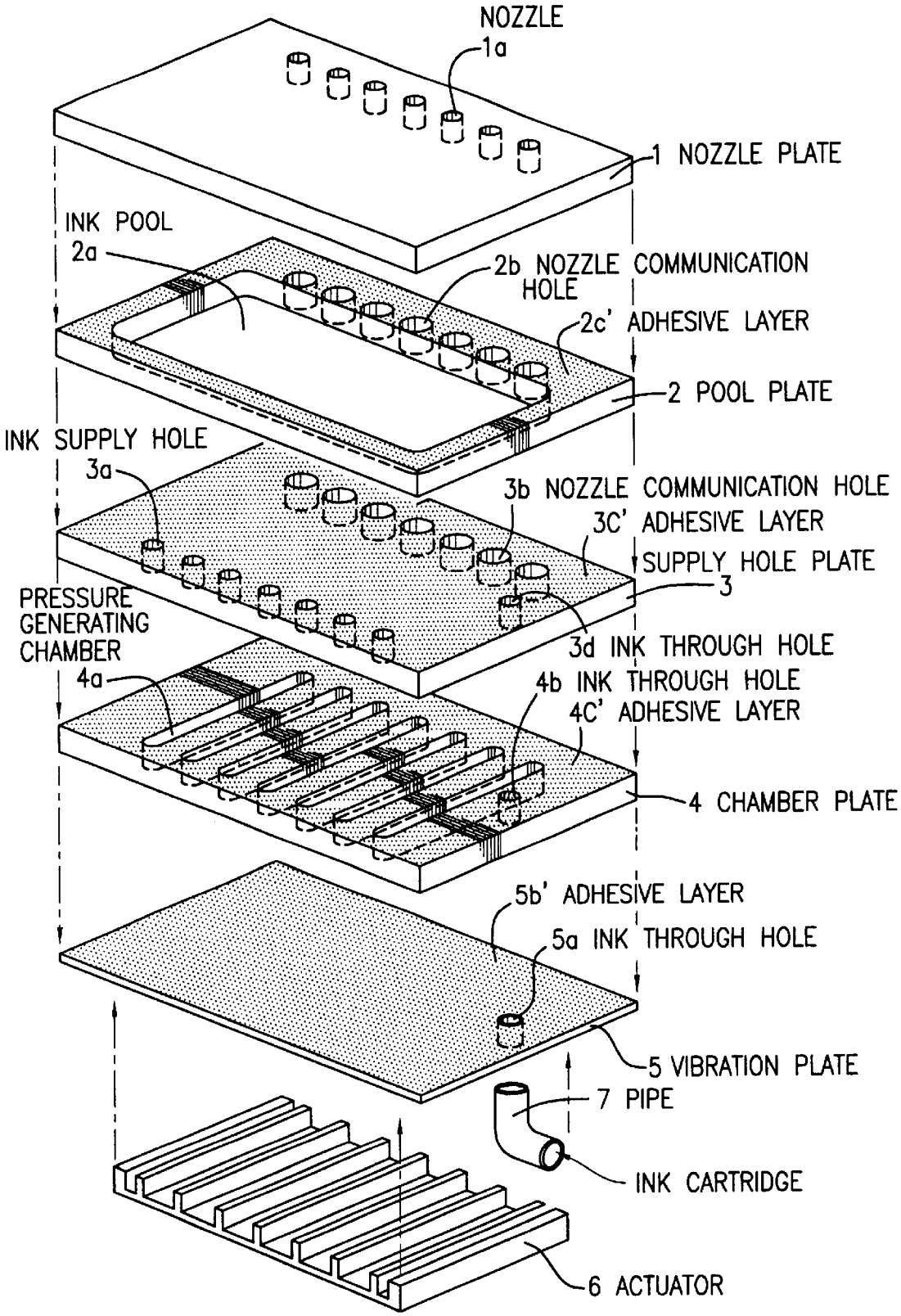
FIG. 5 is an exploded perspective view of the fourth embodiment of the present invention.

FIG. 5 is a perspective view of the fourth embodiment of the present invention.

The present embodiment is identical to the first embodiment except for that the vibration plate is the lowest plate for forming a layered structure.

Here, explanation will be given on the production procedure of the present embodiment.

Firstly, adhesive is applied to the free surface (not having the actuator) of the vibration plate 5, so as to form an adhesive layer 5*b*', onto which the chamber plate 4 is attached. Here, the thickness of the adhesive layer 5*b'* is adjusted according to the thickness of the vibration plate and thickness of the chamber plate 4.

Next, in the same way as mentioned above, adhesive is applied to the free surface (not the vibration plate 5 side) of the chamber plate 4 which has been attached to the vibration plate 5, so as to form an adhesive layer 4*c*', onto which the ink supply hole plate 3 is attached. Here, the adhesive layer 4*c*' has thickness according to the thickness of the chamber plate 4 and thickness of the ink supply hole plate 3 to be attached thereon.

Next, in the same way as mentioned above, adhesive is applied to the free surface (not having the vibration plate 5) of the ink supply hole plate 3 which has been attached to the chamber plate 4, so as to form an adhesive layer 3*c*', onto which the pool plate 2 is attached. Here, the thickness of the adhesive layer 3*c*' is adjusted according to the thickness of the ink supply hole plate 3 and the pool plate 2 which is to be mounted thereon.

Next, in the same way as mentioned above, adhesive applied to the free surface (not the vibration plate 5 side) of the pool plate 2 which has been attached to the ink supply hole plate 3, so as to form an adhesive layer 2*c*', onto which the nozzle plate 1 is attached. Here, the thickness of the adhesive layer 2*c*' is adjusted according to the pool plate 2 and the nozzle plate 1 to be mounted thereon.

After this, load is applied onto the layered substrate while being heated to harden the adhesive layer. Furthermore, the actuator 6 and the pipe 7 are mounted on the vibration plate 5, thus completing an ink jet printing head.

Thus, in the present embodiment, as the substrate becomes thinner, the adhesive layer thickness is also made thinner, which prevents extrusion of adhesive into the holes and grooves provided in the respective substrates. Moreover, when the substrate have a large thickness, more adhesive is applied. In this case, the extruded adhesive is also increased. However, the thick substrate has hole having a greater area of the inner wall than in a thin plate. Even if the adhesive is extruded, it will not flow onto the back side of the substrate or clog holes.

[Embodiment 5]

Description will now be directed to the fifth embodiment of the present invention.

In general, extruded portion of adhesive into a hole or groove tends to flow downward by the gravitation and then spread horizontally. For this, in the present embodiment, the adhesive layer thickness is adjusted according to the thickness of the lower substrate viewed from the adhesive. That is, if the adhesive layer thickness values are compared to one another, an adhesive layer used for attaching a thin substrate is thinner than the adhesive used for attachment of a thicker substrate. The thickness is determined by a lower substrate viewed from the adhesive layer.

Here, a specific procedure will be explained with reference to FIG. 5.

Firstly, adhesive is applied to the free surface (no having the actuator 6) of the vibration plate 5, so as to form an adhesive layer 5*b*', onto which the chamber plate 4 is attached. Here, an extruded portion of the adhesive tends to spread downward and accordingly, the thickness of the adhesive layer 5*b*' is adjusted according to the thickness of the vibration plate 5.

Next, in the same way as mentioned above, adhesive is applied to a free surface (not the vibration plate 5 side) of the chamber plate 4, so as to form an adhesive layer 4*c*', onto which the ink supply hole plate 3 is attached. Here, the thickness of the adhesive layer 4*c*' is adjusted according to the thickness of the chamber plate 4.

Subsequently, in the same way as mentioned above, adhesive is applied to a free surface (not the chamber plate 4 side) of the ink supply hole plate 3, so as to form an adhesive layer 3*c*', onto which the pool plate 2 is attached. Here, thickness of the adhesive layer 3*c*' is adjusted according to the thickness of the ink supply hole plate 3.

Subsequently, adhesive is applied to a free surface (not the ink supply hole plate 3 side) of the pool plate 2, so as to form an adhesive layer 2*c*', onto which the nozzle plate 1 is attached. Here, thickness of the adhesive layer 2*c*' is adjusted according to the thickness of the pool plate 2.

After this, load is applied to the layered substrates while heated so as to harden the adhesive layers. Furthermore, the actuator 6 and the pipe 7 are attached to the vibration plate 5, thus completing an ink jet printing head.

[Embodiment 6]

Description will now be directed to the sixth embodiment of the present invention.

In this embodiment, like in the fourth embodiment, the vibration plate 5 is the lowest layer of the layered structure. Each time a substrate is attached, load is applied. The load is changed according to thickness of the substrate to be attached. This is the difference from the fourth and fifth embodiments.

Figure 6:
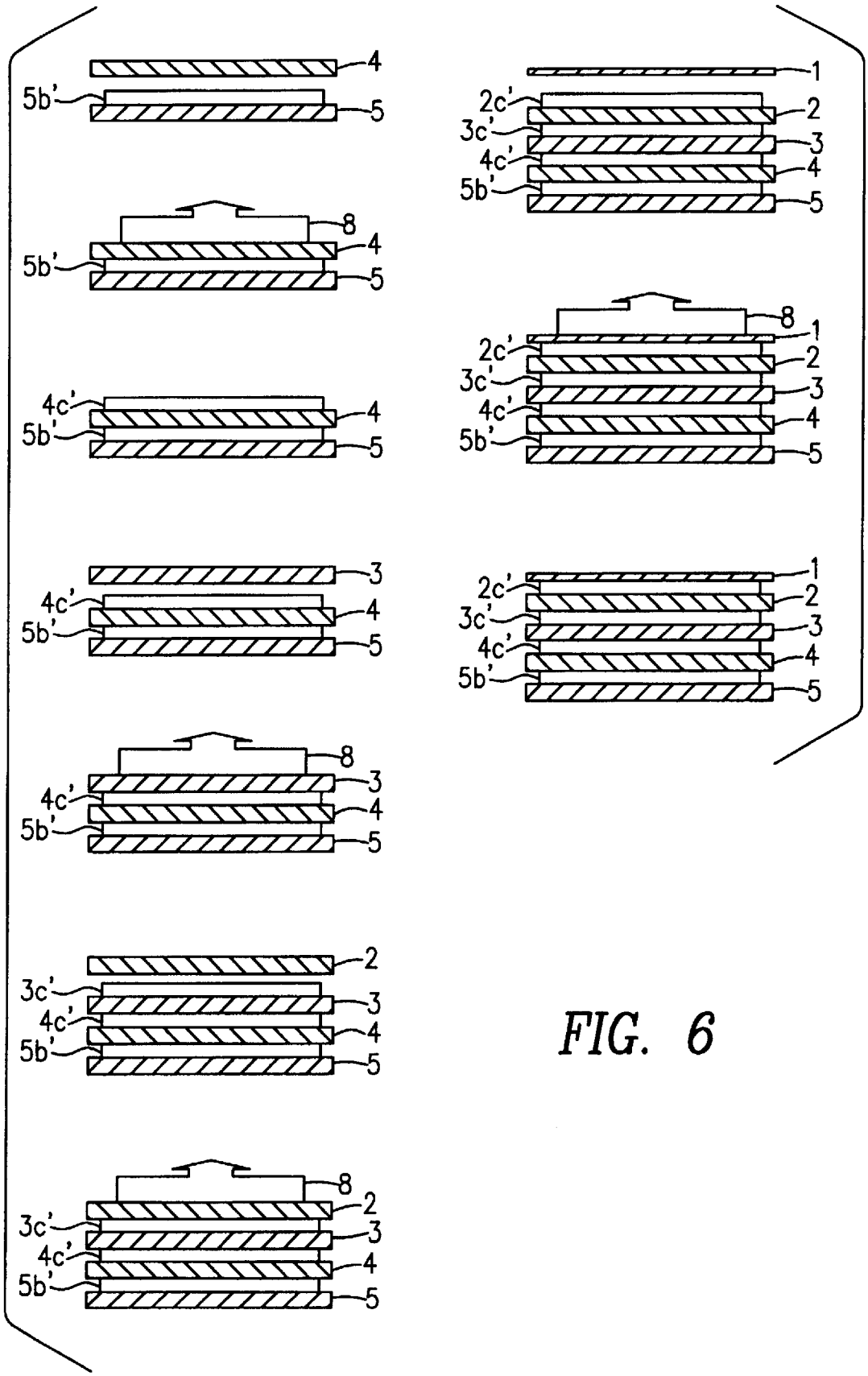
FIG. 6 is a cross sectional view of the sixth embodiment of the present invention.

FIG. 6 is a cross sectional view of the sixth embodiment of the present invention.

Firstly, as shown in FIG. 6(*a*), adhesive is applied to a free surface (not having the actuator 6) of the vibration plate 5, so as to form an adhesive layer 5*b*', onto which the chamber plate 4 is attached. Here, the thickness of the adhesive layer 4*c*' is adjusted according to the vibration plate 5 and the chamber plate 4 to be attached thereon. of course, it is also possible to adjust the thickness according to the thickness of the vibration plate 5 located under the adhesive layer 5*b*'.

Next, as shown in FIG. 6(*b*), a load 8 is applied onto the layered substrates while being heated so as to harden the adhesive layer 5*b*'. Here, the load (weight) is adjusted according to the thickness of the substrate (vibration plate 5) having the adhesive layer. As the substrate increases its thickness, more load (weight) is applied, and as the substrate reduces its thickness, less load is applied.

Subsequently, adhesive is applied to a free surface (not having the vibration plate 5) of the chamber plate 4 which has been attached onto the vibration plate 5, so as to form an adhesive layer 4*c*', onto which the ink supply hole plate 3 is attached. Here, the thickness of the adhesive layer 4*c*' is adjusted according to the thickness of the chamber plate 4 and the thickness of the ink supply hole plate 3 to be attached thereon. of course, like in the second embodiment, it is possible to make adjustment according to the thickness of the chamber plate 4 located below the adhesive layer 4*c*'.

Subsequently, as shown in FIG. 6(*d*), the ink supply hole plate 3 is attached to the chamber plate 4.

Subsequently, as shown in FIG. 6(*e*), load 8 is applied as weight to the layered substrates while being heated so as to harden the adhesive layer 4*c*'. Here, the weight is adjusted according to the thickness of the substrate (chamber plate 4) which has formed the adhesive layer 4*c*'. As the thickness of the substrate increases, more weight is applied, and as the thickness of the substrate decreases, less weight is applied.

Hereinafter, in the same way as mentioned above, steps shown in FIG. 6(*f*) to (*j*) are performed.

After this, the actuator 6 and the pipe 7 are attached to the vibration plate 5, thus completing an in ink jet printing head.

Thus, in this embodiment, weight applied is adjusted according to the substrate thickness. That is, if the substrate has a small thickness, less weight is applied. Accordingly, it is possible to prevent adhesive extrusion into holes and grooves. It should be noted that when the substrate has a large thickness, more weight is applied, increasing the extruded adhesive. However, when the substrate is thick, it has a greater area of the inner wall. Accordingly, even if the adhesive is extruded, it will not reach the back of the substrate or clog holes.

As has been described above, in the Embodiments 1 through 6, epoxy adhesive is used and the adhesive layer is set to 1 to 4 micrometers so that the adhesive extrusion is suppressed to minimum, leaving no irregularities or air bubbles (void), thus enabling to enhance the air tightness between the substrates.

[Embodiment 7]

Description will now be directed to the seventh embodiment.

This embodiment is characterized in that a portion of an adhesive layer in the vicinity of holes or grooves is hardened in a shorter time than the other portion.

Figure 7:
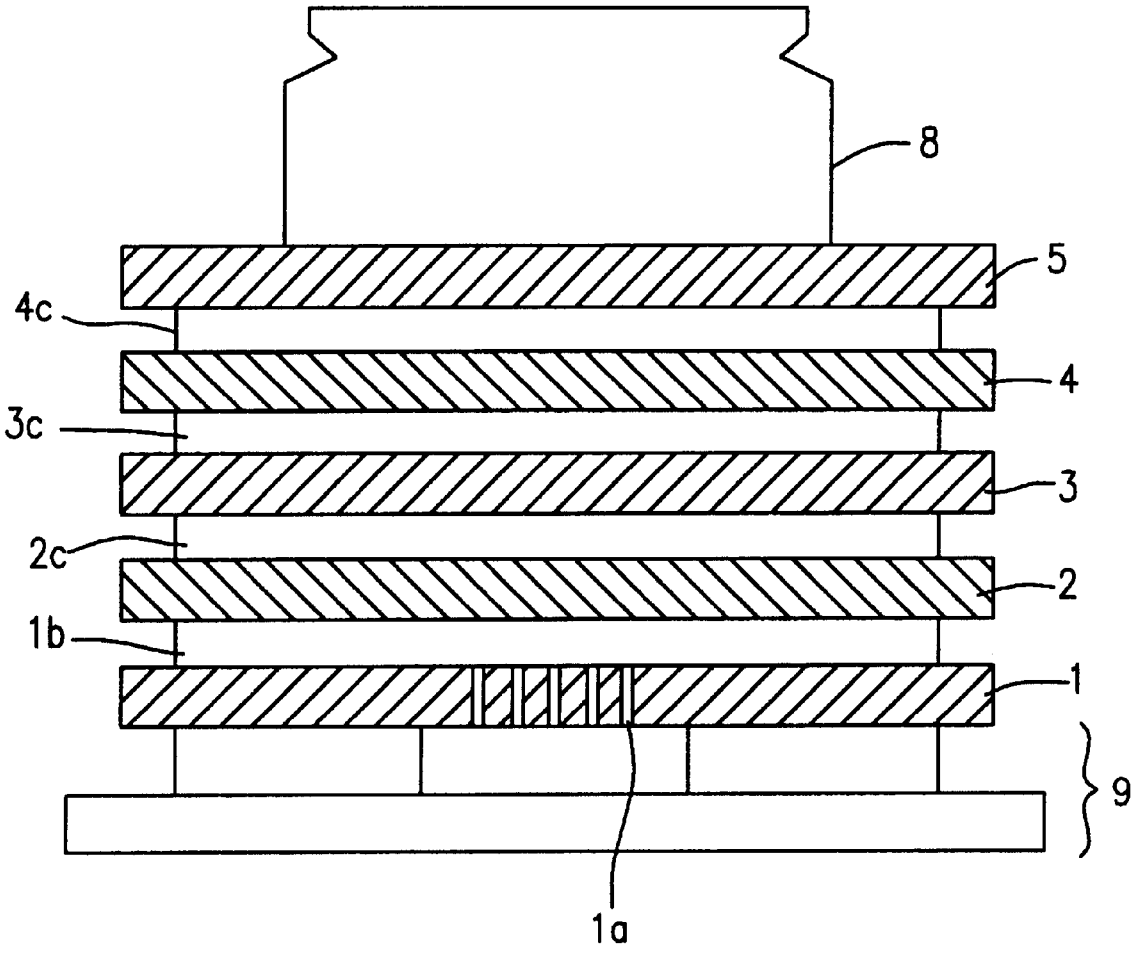
FIG. 7 is a cross sectional view of the seventh embodiment of the present invention.
Figure 8:
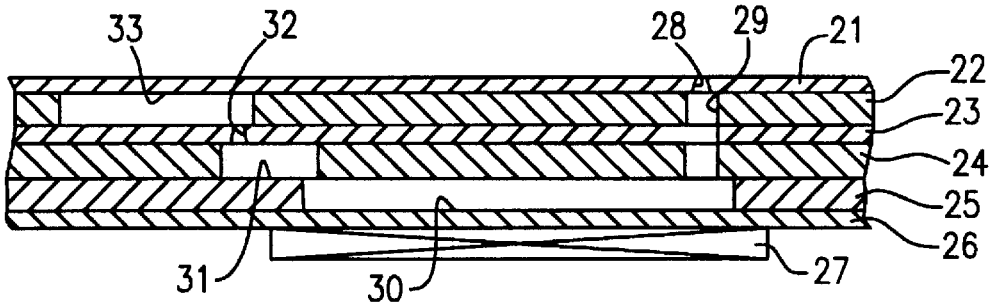
(PRIOR ART) FIG. 8
FIG. 8 is a cross sectional view of a conventional example.
Figure 9:
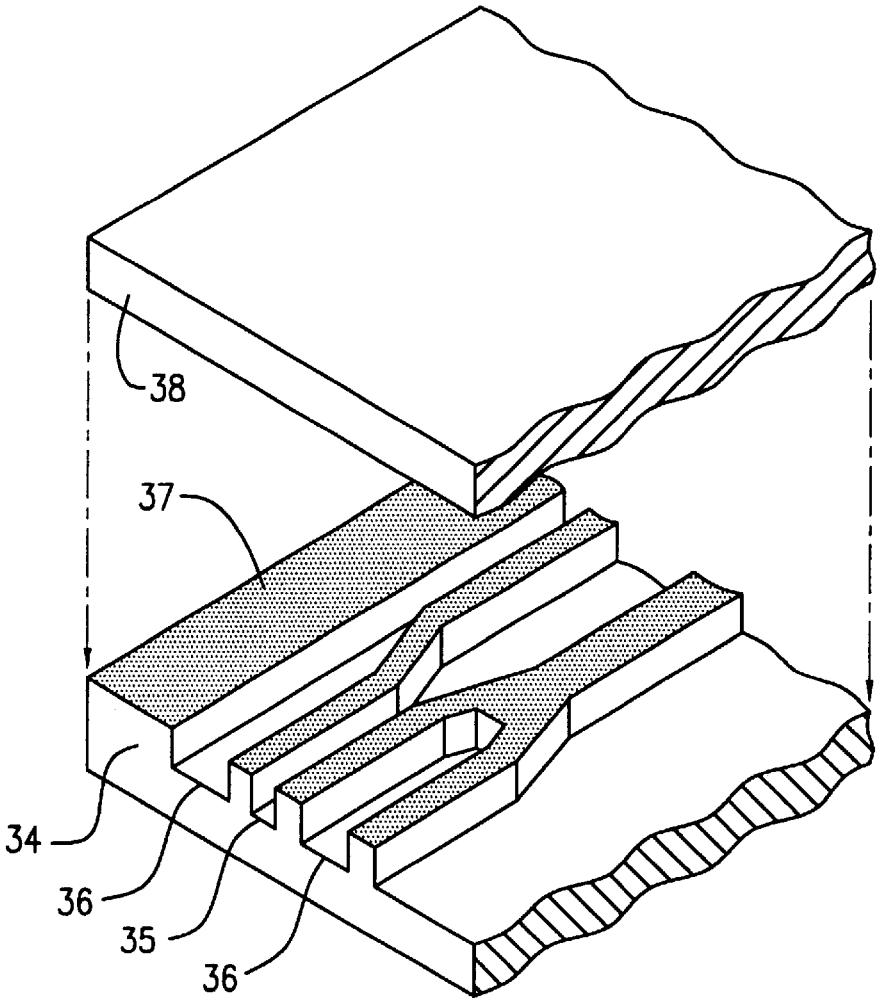
(PRIOR ART) FIG. 9
FIG. 9 is an exploded perspective view of the conventional example.

FIG. 7 is a cross sectional view of the seventh embodiment of the present invention.

Firstly, adhesive is applied to a free surface (not discharging the ink) of the nozzle plate 1, so as to form an adhesive layer 1*b*.

After this, the pool plate 2 is attached to the nozzle plate 1, and adhesive is applied to the free surface of the pool plate 2 (not having the nozzle plate 1), so as to form an adhesive layer 2*c*.

After this, the ink supply hole plate 3 is attached to the pool plate 2, and adhesive is applied to the free surface of the ink supply hole plate (not having the pool plate 2), so as to form an adhesive layer 3*c*.

After this, the chamber plate 4 is attached to the ink supply hole plate 3, and adhesive is applied to the free surface of the chamber plate 4 (not having the ink supply hole plate 3), so as to form an adhesive layer 4*c*.

After this, the vibration plate 5 is attached to the chamber plate 4. And the load (weight) 8 is used to press the layered substrates while being heated, so as to harden the adhesive.

When heating the layered substrates, the adhesive portion near the nozzle 1*a* and other small holes is hardened in a shorter time. More specifically, the layered substrates are placed on a hot plate unit 9, so that the adhesive in the area of the nozzle 1*a* is heated sufficiently. When the attachment by pressurizing and heating is complete, the ink jet printing head is complete.

Thus, in the present embodiment, an adhesive portion around the nozzle and other small holes is hardened than the other portion. The hardened adhesive portion functions as a stopper for the adhesive extrusion. Thus, adhesive extrusion into the small holes is suppressed. Of course, the present embodiment can be applied to any one of the Embodiments 1 through 6.

EXAMPLES

Hereinafter, Examples of the present invention will be explained with reference to the attached drawings.

Example 1

In this example, plate size used was 25 mm×25 mm for all the plates. The thickness of the nozzle plate 1 was 75 micrometers; the pool plate 2, 120 micrometers; the ink supply hole plate 3, 75 micrometers; the chamber plate 4, 140 micrometers; the vibration plate 5, 30 micrometers. As for the nozzle 1*a,* 32 holes were provided in each of four rows on the 25 mm×25 mm nozzle plate 2. The adhesive was liquid epoxy adhesive and applied to the respective plates by way of screen printing method. Moreover, each of the plates had a cross mark for positioning when mounting.

The free surface (not discharging ink) of the nozzle plate 1 was coated by the adhesive to form an adhesive layer having thickness of 7.5 micrometers. The pool plate 2 was mounted on the nozzle plate 1. The free surface of the pool plate (not the nozzle plate 1 side) was coated by the adhesive to form an adhesive layer having thickness of 7.5 micrometers. Then, the ink supply hole plate 3 was placed on the pool plate 2, and the free surface of the ink supply hole plate 3 (not the pool plate 2 side) was coated by the adhesive to form an adhesive layer having thickness of 7.5 micrometers. Then, the chamber plate 4 was mounted. The free surface of the chamber plate 4 (not the ink supply hole plate 3 side) was coated with the adhesive to form an adhesive layer having thickness of 3 micrometers, and the vibration plate 5 was mounted. After this, weight of 4 kgf was applied to the layered substrates using the deadweight method while heating the layered substrates at 120 degrees C. for 60 minutes to harden the adhesive.

In this Example, 500 pieces of ink jet printing head were produced. We checked ink discharge of each of the heads and disassembled the heads to check their interiors. It was found that an average adhesive extrusion into the ink supply holes 3*a* and around the pressure generating chamber 4*a* was equal to or below 10 micrometers. The production yield of the head was 80%.

Example 2

In this example, like in the first example, the plate size used was 25 mm×25 mm for all the plates. The thickness of the nozzle plate 1 was 75 micrometers; the pool plate 2, 120 micrometers; the ink supply hole plate 3, 75 micrometers; the chamber plate 4, 140 micrometers; the vibration plate 5, 30 micrometers. The adhesive was epoxy adhesive and applied to the respective plates by way of screen printing method.

The free surface (not discharging ink) of the nozzle plate 1 was coated by the adhesive to form an adhesive layer having thickness of 4 micrometers. The pool plate 2 was mounted on the nozzle plate 1. The free surface of the pool plate (not the nozzle plate 1 side) was coated by the adhesive to form an adhesive layer having thickness of 6 micrometers. Then, the ink supply hole plate 3 was placed on the pool plate 2, and the free surface of the ink supply hole plate 2 (not the pool plate 2 side) was coated by the adhesive to form an adhesive layer having thickness of 4 micrometers. Then, the chamber plate 4 was mounted. The free surface of the chamber plate 4 (not the ink supply hole plate 3 side) was coated with the adhesive to form an adhesive layer having thickness of 7 micrometers, and the vibration plate 5 was mounted. Moreover, each of the plates had a cross mark for positioning when mounting. After this, weight of 4 kgf was applied to the layered substrates using the deadweight method while heating the layered substrates at 120 degrees C. for 60 minutes to harden the adhesive.

In this Example, 500 pieces of ink jet printing head were produced. We checked ink discharge of each of the heads and disassembled the heads to check their interiors. It was found that the pressure generating chamber and the ink pool had sufficient air tightness and no peeling was found between the adhesive and plates. An average adhesive extrusion into the ink supply holes 3*a* and around the pressure generating chamber 4*a* was equal to or below 10 micrometers. The production yield of the head was 85%.

It should be noted that we produced 500 ink jet printing heads by modifying the adhesive thickness as follows:

- 2 micrometers between the nozzle plate 1 and the pool plate 2;
- 3 micrometers between the pool plate 2 and the ink supply hole plate 3;
- 2 micrometers between the ink supply hole plate 3 and the chamber plate 4; and
- 3.5 micrometers between the chamber plate 4 and the vibration plate 5.

It was found that the air tightness of the pressure generating chamber and the ink pool was increased and no peeling was found between the adhesive and the plates. Moreover, the average adhesive extrusion into the holes 3*a* and around the pressure generating chambers 4*a* was equal to or below 10 micrometers. The head production yield was improved to 90%.

Example 3

In this example, like in the first example, the plate size used was 25 mm×25 mm for all the plates. The thickness of the nozzle plate 1 was 75 micrometers; the pool plate 2, 120 micrometers; the ink supply hole plate 3, 75 micrometers; the chamber plate 4, 140 micrometers; the vibration plate 5, 30 micrometers. The adhesive was epoxy liquid adhesive and applied to the respective plates by way of screen printing method.

Firstly, the adhesive was applied to the free surface of the nozzle plate 1 (not performing ink discharge) so as to form an adhesive layer of 2 micrometers thickness, and the pool plate 2 was mounted thereon. The layered substrates were subjected to 4 kgf pressure and heated at 120 degrees C. for 60 minutes. After the adhesive was hardened, the adhesive was applied to the free surface of the pool plate 2 (not the nozzle plate 1 side) so as to form an adhesive layer of 3 micrometers thickness and the ink supply hole plate 3 was mounted thereon. The layered plates were subjected to 6 kgf and heated at 120 degrees C. for 60 minutes. After the adhesive was hardened, the adhesive was applied to the free surface of the ink supply hole plate 3 (not the pool plate 2 side) so as to form an adhesive layer of 2 micrometers thickness, and the chamber plate 4 was mounted thereon. The layered plates were subjected to 4 kgf while heated at 120 degrees C. for 60 minutes so as to harden the adhesive. The free surface of the chamber plate 4 (not the ink supply hole plate 3 side) was coated by the adhesive having a thickness of 3.5 micrometers and the vibration plate 5 was mounted thereon. The layered plates were subjected to 7 kgf while heated at 120 degrees C. for 60 minutes to harden the adhesive. It should be noted that positioning of the plates was performed using the cross mark provided on the plates.

In this Example, 500 pieces of ink jet printing head were produced. Each of the heads was checked for ink discharge and exploded to check their interiors. It was found that the pressure generating chamber and the ink pool had sufficient air tightness and no peeling was found between the adhesive layers and the plates. The average adhesive extrusion was equal to or below 10 micrometers. The production yield was 92%.

Example 4

In this example, like in the first example, the plate size used was 25 mm×25 mm for all the plates. The thickness of the nozzle plate 1 was 75 micrometers; the pool plate 2, 120 micrometers; the ink supply hole plate 3, 75 micrometers; the chamber plate 4, 140 micrometers; the vibration plate 5, 30 micrometers. The adhesive was epoxy liquid adhesive and applied to the respective plates by way of screen printing method.

The free surface (not having the actuator) of the vibration plate 5 was coated with the adhesive to form an adhesive layer of 2 micrometers thickness, and the chamber plate 4 was mounted thereon. After this, the free surface (not the vibration plate 5 side) of the chamber plate 4 was coated with the adhesive to form an adhesive layer of 7 micrometers thickness. The ink supply hole plate 3 was mounted on the chamber plate 4. After this, the free surface (not the chamber plate 4 side) of the ink supply hole plate 3 was coated with the adhesive to form an adhesive layer of 4 micrometer thickness and the pool plate 2 was mounted thereon. The free surface (not the ink supply hole plate 3 side) of the pool plate 2 was coated with the adhesive to form an adhesive layer of 6 micrometer thickness and the vibration plate 5 was mounted thereon. It should be noted that each of the plates had a cross mark for positioning.

After this, the layered plates were subjected to 4 kgf by the deadweight method while heated at 120 degrees C. for 60 minutes.

In this Example, 500 pieces of ink jet printing head were produced. Each of the heads was checked for ink discharge and exploded to check their interiors. It was found that the pressure generating chamber and the ink pool had sufficient air tightness and no peeling was found between the adhesive layers and the plates. The average adhesive extrusion was equal to or below 10 micrometers. The production yield was 85%.

It should be noted that another 500 pieces of in jet printing head were produced modifying the adhesive thickness values as follows:

1 micrometer between the vibration plate 5 and the chamber plate 4;

3.5 micrometers between the chamber plate 4 and the ink supply hole plate 3;

2 micrometers between the ink supply hole plate 3 and the pool plate 2; and 3 micrometers between the pool plate 2 and the nozzle plate 1.

It was found that the air tightness of the pressure generating chamber and the ink pool was improved and no peeling was found between the adhesive layers and the plates. The average adhesive extrusion into the ink supply holes 3*a* and around the pressure generating chambers 4*a* was equal to or less than 10 micrometers. The production yield was improved to 90%.

Example 5

In this example, like in the first example, the plate size used was 25 mm×25 mm for all the plates. The thickness of the nozzle plate 1 was 75 micrometers; the pool plate 2, 120 micrometers; the ink supply hole plate 3, 75 micrometers; the chamber plate 4, 140 micrometers; the vibration plate 5, 30 micrometers. The adhesive was epoxy liquid adhesive and applied to the respective plates by way of screen printing method.

Firstly, the adhesive was applied to the free surface (not having the actuator) of the vibration plate 5 to form an adhesive layer of 1 micrometer thickness and the chamber plate 4 was mounted thereon. After this, the layered plates were subjected to 2 kgf by the deadweight method while heated at 120 degree C. for 60 minutes. After the adhesive was hardened, the free surface (not the vibration plate 5 side) of chamber plate 4 was coated with the adhesive to form an adhesive layer of 3.5 micrometer thickness, and the ink supply hole plate 3 was mounted thereon. After this, the layered plates were subjected to 7 kgf while heated at 120 degrees C. for 60 minutes. After the adhesive was hardened, the free surface (not the chamber plate 4 side) of the ink supply hole plate 3 was coated with the adhesive to form an adhesive layer of 2 micrometer thickness and the pool plate 2 was mounted thereon. The layered plates were subjected to 4 kgf while heated at 120 degrees C. for 60 minutes so as to harden the adhesive. Then, the free surface (not the ink supply hole plate 3 side) of the pool plate 2 was coated with the adhesive to form an adhesive layer of 3 micrometer thickness, and the nozzle plate 1 was mounted thereon. The layered plates were subjected to 6 kgf while heated at 120 degrees C. for 60 minutes. It should be noted that positioning when mounting the plates was performed using the cross mark provided on the respective plates.

In this Example, 500 pieces of ink jet printing head were produced. Each of the heads was checked for ink discharge and exploded to check their interiors. It was found that the pressure generating chamber and the ink pool had sufficient air tightness and no peeling was found between the adhesive layers and the plates. The average adhesive extrusion was equal to or below 10 micrometers. The production yield was 92%.

Example 6

In this example, like in the first example, the plate size used was 25 mm×25 mm for all the plates. The thickness of the nozzle plate 1 was 75 micrometers; the pool plate 2, 120 micrometers; the ink supply hole plate 3, 75 micrometers; the chamber plate 4, 140 micrometers; the vibration plate 5, 30 micrometers. The adhesive was epoxy liquid adhesive and applied to the respective plates by way of screen printing method.

The respective plates were attached to one another via adhesive layers, each having a thickness of 4 micrometers. For positioning for mounting the plates, each of the plates had a cross mark. While applying 2 kgf using the deadweight method, heating was performed at 120 degrees C. for 60 minutes using a hot plate unit 9 which can be partially adjusted in temperature. Here, the hot plate unit 9 was set to increase the temperature from 60 to 120 degrees C. in 30 seconds for the nozzle 1*a* and other small holes such as ink through holes, so as to harden the adhesive quickly in these portions than the other portions.

In this Example, 500 pieces of ink jet printing head were produced. Each of the heads was checked for ink discharge and exploded to check their interiors. It was found that the pressure generating chamber and the ink pool had sufficient air tightness and no peeling was found between the adhesive layers and the plates. The average adhesive extrusion was equal to or below 10 micrometers. The production yield was 95%.

In this embodiment, the means for quickly hardening the adhesive portion in the vicinity of the nozzle and ink through holes is realized by the hot plate unit 9 in which the temperature gradient can be adjusted. However, this means can also be realized by other means. For example, it is also possible to apply a hot bast or ultraviolet rays to obtain the equivalent effect as the hot plate unit.

Moreover, in the aforementioned embodiments, adhesive was applied by using the screen printing method. However, it is also possible to use the stamp method to obtain the same effect.

Furthermore, the load applied by the deadweight method can be replaced by other means such as a spring or compressed air which can apply a uniform weight.

As has been described above, claim 1 discloses an ink jet printing head comprising a plurality of substrates having a hole or groove which are attached to one another via an adhesive layer, wherein thickness of adhesive is adjusted according to a thinner substrate as a reference of two substrates to be attached to each other in such a way that the thickness of the adhesive becomes thinner as the reference substrate becomes thinner and thicker as the reference substrate becomes thicker.

Thus, according to the present invention, the adhesive thickness is adjusted according to a thinner one of adjacent substrates. Accordingly, it is possible to prevent adhesive extrusion into holes and grooves provided in the substrates which may cause clogging. The same effect can be obtained by the ink jet printing head disclosed in claim 2.

In the ink jet printing head claimed in claim claims 3 and 4 is as claimed in one of claim 1 and claim 2, wherein each of the adhesive layers is formed by an epoxy adhesive with a thickness 1 to 4 micrometers.

This can further reduce the adhesive extrusion. When the thickness is equal to or above 1 micrometer, no irregularities or no air bubbles (void) remain.

Claim 5 discloses a production method of an ink jet printing head comprising a plurality of substrates having a hole or groove which are attached to one another via an adhesive layer, wherein thickness of adhesive is adjusted according to a thinner substrate as a reference of two substrates to be attached to each other in such a way that the thickness of the adhesive becomes thinner as the reference substrate becomes thinner and thicker as the reference substrate becomes thicker.

Thus, in this invention, the adhesive thickness is determined according to a thinner one of two adjacent substrates and it is possible to prevent the adhesive extrusion and the resulting clogging. The ink jet printing head production method disclosed in claim 6 can also have the same effect.

Claim claims 7 and 8 discloses an ink jet printing head production method as claimed in one of claim 5 and claim 6, wherein each of the adhesive layers is formed by an epoxy adhesive with a thickness 1 to 4 micrometers.

Thus, in this prevention, the adhesive extrusion is further reduced. If the adhesive thickness is equal to or above 1 micrometer, no irregularities or no air bubbles (void) remain.

Claim 9 discloses an ink jet printing head production method as claimed in claim 6, comprising steps of: applying adhesive onto the nozzle plate so as to form an adhesive layer and mounting the pool plate thereon; applying adhesive onto the pool plate so as to form an adhesive layer and mounting the ink supply hole plate thereon; applying adhesive onto the ink supply hole plate so as to form an adhesive layer and mounting the chamber plate thereon; and applying adhesive onto the chamber plate so as to for an adhesive layer and mounting the vibration plate thereon; wherein the thickness values of the respective adhesive layers are adjusted in proportion to the respective thickness values of the substrates to be attached to the nozzle plate.

Thus, in this invention, for example, when the nozzle plate serves as the lowest substrate, on which the other plates are mounted one after another, the adhesive extrusion mainly occurs in the nozzle plate direction, and the adhesive layer thickness is determined according to the plate thickness. Accordingly, it is possible to minimize the extrusion and improve air tightness between plates. When the plate thickness is small, holes and grooves provided in the plate have inner walls of small area and the adhesive thickness is also made small. This prevents adhesive extrusion into the holes and grooves as well as resulting clogging.

Claim 10 discloses an ink jet printing head production method as claimed in claim 9, wherein each time a substrate is attached to the nozzle plate side, the substrate is pressed with a pressure proportional to thickness of the substrate.

When the nozzle plate is the lowest plate on which the other plates are successively mounted, the adhesive extrusion occurs mainly in the direction of the nozzle plate and the pressure proportional to the plate thickness is applied to the plate. This reduces adhesive extrusion and improves the air tightness between plates. When the plate thickness is small, holes and grooves arranged in the plates also have a small area of the inner wall. According to this, the pressure is also proportionally reduced. Thus, it is possible to prevent adhesive extrusion into the holes and grooves arranged in the plates and resultant clogging.

Claim 11 discloses an ink jet printing head production method as claimed in claim 6, comprising steps of: applying adhesive onto the vibration plate to form an adhesive layer, and attaching the chamber plate onto the vibration plate; applying adhesive onto the chamber plate to form an adhesive layer, and attaching the ink supply hole plate onto the chamber plate; applying adhesive onto the ink supply hole plate to form an adhesive layer, and attaching the pool plate onto the ink supply hole plate; and applying adhesive onto the pool plate to form an adhesive layer, and attaching the nozzle plate onto the pool plate; wherein the respective adhesive layers have thickness values proportional to the thickness of the substrates attached to the vibration plate side.

When the vibration plate is the lowest plate on which the other plates are successively mounted, the adhesive extrusion occurs mainly in the direction of the vibration plate, and the adhesive layer thickness is determined according to the corresponding plate thickness. This can minimize the adhesive extrusion and improves the air tightness between the plates. When the plate thickness is small, holes and grooves arranged in the plate also have a small area of the inner walls, the adhesive layer also has a small thickness. Thus, it is possible to prevent adhesive extrusion into the holes and grooves arranged in the respective plates and resultant clogging.

Moreover, claim 12 discloses an ink jet printing head production method as claimed in claim 11, wherein each time a substrates is attached, the substrate is pressed with a pressure proportional to the thickness of the substrate.

When the vibration plate is the lowest plate on which the other plates are successively mounted, the adhesive extrusion occurs mainly in the direction of the vibration plate. Pressure applied is roughly proportional to the plate thickness. Thus, it is possible to minimize the adhesive extrusion and improve the air tightness between the plates. When the plate thickness is small, holes and grooves arranged in the plate also have a small area of the inner wall. However, the pressure applied is also made small to be proportional to the thickness. Accordingly, it is possible to prevent adhesive extrusion into holes and grooves and resultant clogging.

Claims 13–15 discloses an ink jet printing head production method as claimed in one of claims 5 to 12, wherein the adhesive layers in the vicinity of a hole or indentation are hardened in a time shorter than the other region of the adhesive layers.

Thus, in this invention, in the vicinity of small holes, the adhesive is hardened before extruding. That is, it is possible to prevent adhesive extrusion. As has been described above, the present invention suppresses adhesive extrusion in the ink flow path and causing no irregularities or air bubbles (void). Consequently, it is possible to improve reliability and production yield as well as to reduce the production cost.

The invention may be embodied in other specific forms without departing from the spirit or essential characteristic thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 10-346970 (Filed on Dec. $7^{th}$, 1998) including specification, claims, drawings and summary are incorporated herein by reference in its entirety.

What is claimed is:

1. An ink jet printing head comprising a plurality of substrates, at least two of said plurality of substrates being attached to one another by way of an adhesive layer, wherein a thickness of said adhesive layer is determined by a thickness of a reference substrate, said reference substrate being the thinner of said at least two of said plurality of substrates,, such that the thinner said reference substrate the thinner said adhesive layer is made, and the thicker said reference substrate the thicker said adhesive layer is made.

2. The ink jet printing head as claimed in claim 1, wherein said plurality of substrates comprises:

a nozzle plate including a nozzle that discharges ink;

a pool plate including an ink pool and a first nozzle communication hole;

an ink supply hole plate including an ink supply hole and a second nozzle communication hole;

a chamber plate including a pressure generating chamber; and a vibration plate including an actuator that generates displacement, wherein said nozzle is connected to said pressure generating chamber by way of said first and said second nozzle communication holes, and said pressure generating chamber is connected to said ink pool by way of said ink supply hole.

3. The inkjet printing head as claimed in claim 1, wherein each of said adhesive layers comprises an epoxy adhesive having a thickness of 1 to 4 micrometers.

4. The ink jet printing head as claimed in claim 2, wherein each of the adhesive layers comprises an epoxy adhesive having a thickness of 1 to 4 micrometers.

5. A production method of an ink jet printing head comprising a plurality of substrates, at least two of said plurality of substrates being attached to one another by way of an adhesive layer, wherein a thickness of said adhesive layer is determined by a thickness of a reference substrate, said reference substrate being the thinner of said at least two of said plurality of substrates, such that the thinner said reference substrate the thinner said adhesive layer is made, and the thicker said reference substrate the thicker said adhesive layer is made.

6. The ink jet printing head production method as claimed in claim 5, wherein said plurality of substrates comprises:

a nozzle plate including a nozzle that discharges ink;

a pool plate including an ink pool and a first nozzle communication hole;

an ink supply hole plate including an ink supply hole and a second nozzle communication hole;

a chamber plate including a pressure generating chamber; and a vibration plate including an actuator that generates displacement, wherein said nozzle is connected to said pressure generating chamber by way of said first and said second nozzle communication holes, and said pressure generating chamber is connected to said ink pool by way of said ink supply hole.

7. The ink jet printing head production method as claimed in claim 6, wherein each of said adhesive layers comprises an epoxy adhesive having a thickness of 1 to 4 micrometers.

8. The ink jet printing head production method as claimed in claim 5, wherein each of said adhesive layers comprises an epoxy adhesive having a thickness of 1 to 4 micrometers.

9. The ink jet printing head production method as claimed in claim 5, further comprising hardening the adhesive layers in the approximate region of said ink supply hole or said nozzle communication hole in a time shorter than the time in which the other regions of the adhesive layers are hardened.

10. A method for producing an ink jet printing head, said ink jet printing head comprising a plurality of substrates, said plurality of substrates including: a nozzle plate that includes a nozzle for discharging ink; a pool plate that includes an ink pool and a first nozzle communication hole; an ink supply hole plate that includes an ink supply hole and a second nozzle communication hole; a chamber plate that includes a pressure generating chamber; and a vibration plate that includes an actuator for generating displacement; wherein said nozzle is connected to said pressure generating chamber by way of said first and said second nozzle communication holes, and wherein said pressure generating chamber is connected to said ink pool by way of said ink supply hole; said method comprising the steps of:

applying a first layer of adhesive to a surface of said nozzle plate, a thickness of said first adhesive layer being proportional to a thickness of said nozzle plate;

mounting said pool plate on said surface of said nozzle plate such that said first layer of adhesive lies between said nozzle plate and said pool plate;

applying a second layer of adhesive to a surface of said pool plate, a thickness of said second adhesive layer being proportional to a thickness of said pool plate;

mounting said ink supply hole plate on said surface of said pool plate such that said second layer of adhesive lies between said pool plate and said ink supply hole plate;

applying a third layer of adhesive to a surface of said ink supply hole plate, a thickness of said third adhesive layer being proportional to a thickness of said ink supply hole plate;

mounting said chamber plate on said ink supply hole plate such that said third layer of adhesive lies between said ink supply hole plate and said chamber plate;

applying a fourth layer of adhesive to a surface of said chamber plate, a thickness of said fourth adhesive layer being proportional to a thickness of said chamber plate; and mounting said vibration plate on said chamber plate, such that said fourth layer of adhesive lies between said chamber plate and said vibration plate.

11. The ink jet printing head production method as claimed in claim 10, wherein each of said mounting steps further includes pressing said substrate that is being mounted with a pressure that is proportional to a thickness of the substrate being mounted.

12. The ink jet printing head production method as claimed in claim 10, further comprising hardening the adhesive layers in the approximate region of said ink supply hole or said nozzle communication hole in a time shorter than the time in which the other regions of the adhesive layers are hardened.

13. A method for producing an ink jet printing head, said ink jet printing head comprising a plurality of substrates, said plurality of substrates including: a nozzle plate that includes a nozzle for discharging ink; a pool plate that includes an ink pool and a first nozzle communication hole; an ink supply hole plate that includes an ink supply hole and a second nozzle communication hole; a chamber plate that includes a pressure generating chamber; and a vibration plate that includes an actuator for generating displacement; wherein said nozzle is connected to said pressure generating chamber by ways of said first and said second nozzle communication holes, and wherein said pressure generating chamber is connected to said ink pool by way of said ink supply hole; said method comprising the steps of:

applying a first layer of adhesive to a surface of said vibration plate, a thickness of said first adhesive layer being proportional to a thickness of said vibration plate;

mounting said chamber plate on said surface of said vibration plate such that said first layer of adhesive lies between said chamber plate and said vibration plate;

applying a second layer of adhesive to a surface of said chamber plate, a thickness of said second adhesive layer being proportional to a thickness of said chamber plate;

mounting said ink supply hole plate on said surface of said chamber plate, such that said second layer of adhesive lies between said chamber plate and said ink supply hole plate;

applying a third layer of adhesive to a surface of said ink supply hole plate, a thickness of said third adhesive layer is proportional to a thickness of said ink supply hole plate;

mounting said pool plate on said surface of said ink supply hole plate such that said third layer of adhesive lies between said pool plate and said ink supply hole plate;

applying a fourth layer of adhesive to a surface of said pool plate, a thickness of said fourth adhesive layer being proportional to a thickness of said pool plate; and mounting said pool plate on said nozzle plate, such that said fourth layer of adhesive lies between said pool plate and said nozzle plate.

14. The ink jet printing head production method as claimed in claim 13, wherein each of said mounting steps further includes pressing said substrate that is being mounted with a pressure that is proportional to a thickness of the substrate being mounted.

15. The ink jet printing head production method as claimed in claim 13, further comprising hardening the adhesive layers in the approximate region of said ink supply hole or said nozzle communication hole in a time shorter than the time in which the other regions of the adhesive layers are hardened.

* * * * *